US008091933B1

(12) United States Patent
Hemann et al.

(10) Patent No.: US 8,091,933 B1
(45) Date of Patent: Jan. 10, 2012

(54) HEAVY DUTY DOOR LATCH AND RELEASE MODULES

(75) Inventors: Brandon L. Hemann, New Hampton, IA (US); Robert W. Donaldson, Eureka, MO (US); Dennis J. Zweibohmer, Ionia, IA (US)

(73) Assignee: Trimark Corporation, New Hampton, IA (US)

( * ) Notice: Subject to any disclaimer, the term of this patent is extended or adjusted under 35 U.S.C. 154(b) by 964 days.

(21) Appl. No.: 11/859,191

(22) Filed: Sep. 21, 2007

(51) Int. Cl.
*E05C 3/06* (2006.01)
*E05B 65/10* (2006.01)

(52) U.S. Cl. ..... 292/198; 292/92; 292/216; 292/336.3

(58) Field of Classification Search ..... 292/92, 292/198, 216, 336.3
See application file for complete search history.

(56) References Cited

U.S. PATENT DOCUMENTS

| | | | | | |
|---|---|---|---|---|---|
| 3,666,308 | A | * | 5/1972 | Bonnaud | 292/336.3 |
| 3,781,045 | A | * | 12/1973 | Watermann | 292/216 |
| 3,840,258 | A | * | 10/1974 | Brackmann | 292/216 |
| 4,049,305 | A | * | 9/1977 | Zetterlund et al. | 292/336.3 |
| 4,478,441 | A | * | 10/1984 | Fiordellisi et al. | 292/216 |
| 4,506,922 | A | * | 3/1985 | Horgan, Jr. | 292/336.3 |
| 4,858,971 | A | * | 8/1989 | Haag et al. | 292/201 |
| 4,917,412 | A | * | 4/1990 | Swan et al. | 292/48 |
| 5,011,202 | A | * | 4/1991 | Kato et al. | 292/336.3 |
| 5,531,488 | A | * | 7/1996 | Yoshikuwa et al. | 292/216 |
| 5,613,717 | A | * | 3/1997 | Ha | 292/336.3 |
| 5,655,798 | A | * | 8/1997 | Kaveney et al. | 292/3 |
| 5,663,520 | A | | 9/1997 | Ladika et al. | |
| 5,794,994 | A | * | 8/1998 | Miyagawa et al. | 292/336.3 |
| 5,895,081 | A | * | 4/1999 | Tanimoto et al. | 292/348 |
| 5,896,767 | A | * | 4/1999 | Gomi | 70/237 |
| 6,167,779 | B1 | * | 1/2001 | Sano et al. | 74/543 |
| 6,419,284 | B1 | * | 7/2002 | Kutschat | 292/56 |
| 6,511,104 | B1 | * | 1/2003 | Horgan, Jr. | 292/92 |
| 6,726,257 | B2 | * | 4/2004 | Horgan, Jr. | 292/336.3 |
| 6,976,717 | B2 | * | 12/2005 | Barr et al. | 292/336.3 |
| 6,988,752 | B2 | * | 1/2006 | Belchine et al. | 292/336.3 |
| 7,066,506 | B2 | * | 6/2006 | Pudney | 292/336.3 |
| 7,080,861 | B2 | * | 7/2006 | Watanabe | 292/216 |

(Continued)

FOREIGN PATENT DOCUMENTS

WO WO 9119875 A1 * 12/1991

OTHER PUBLICATIONS

Product No. 050-0106 "Two-Rotor Latch With Direct Pull Actuation and Remote Inside Release", Catalog pages, TriMark Interactive Product Selector, www.trimarkcorp.com (06/06-2).

(Continued)

*Primary Examiner* — Carlos Lugo
(74) *Attorney, Agent, or Firm* — McKee, Voorhees & Sease, P.L.C.

(57) ABSTRACT

A heavy duty vehicle door latch assembly is provided with interconnected latch, release, and bell crank modules to form a single, pre-assembled unit for quick and easy installation on the inside of a vehicle door. The modular design allows for application to multiple door layouts and arrangements. The release module includes a locking mechanism using a lever rod to disallow latch component movement. A release lever interfaces with the lock lever to automatically unlock and release the latch in a single motion. A lockout feature is also provided to prevent accidental locking of the door.

29 Claims, 19 Drawing Sheets

U.S. PATENT DOCUMENTS

| | | | | |
|---|---|---|---|---|
| 7,097,216 | B2 | 8/2006 | Lane et al. | |
| 7,111,879 | B2 | 9/2006 | Zweibohmer et al. | |
| 7,198,308 | B2 | 4/2007 | Lane et al. | |
| 7,309,087 | B2 * | 12/2007 | Lane et al. | 292/216 |
| 7,360,808 | B2 * | 4/2008 | Odahara et al. | 292/336.3 |
| 2007/0262591 | A1 * | 11/2007 | Wright et al. | 292/216 |

OTHER PUBLICATIONS

Product No. 020-0900 "Remote Inside Release", Catalog pages, TriMark Interactive Product Selector, www.trimarkcorp.com (06/06-5).

* cited by examiner

HEAVY DUTY DOOR LATCH AND RELEASE MODULES

FIELD OF THE INVENTION

The present invention relates to a vehicle door latch assembly, and particularly to an assembly adapted for use on heavy duty doors, such as military armored vehicles. The assembly functions for closing, latching, locking, unlocking, unlatching, and opening an occupant door of a heavy duty off-road and/or armored military vehicle.

BACKGROUND OF THE INVENTION

Conventional consumer automobiles and trucks have doors which typically weigh 50-60 pounds. Heavy duty vehicles, such as armored military vehicles, have doors which weigh 500-600 pounds. Standard door locks and latches for automobiles, heavy truck and other specialty vehicles will not stand up to the rigors required of such heavy duty vehicles, such as repeated cycles, vibration, dust and dirt, extreme temperatures, arms fire and bomb blasts.

Manufacturers of heavy duty vehicles, including armored military vehicles and other off-road vehicles, currently purchase separate components for the closing, latching, and locking of a vehicle door. Such components typically include an inside door release, a latch assembly, a locking logic assembly, interlocking control rods, a bell crank interface for exterior door handle actuation, an occupant pull handle for inside the door, and covers or housings for the individual components. All of these pieces are mounted separately to the door and then interconnected to one another. Significant positioning adjustment is often necessary for proper function of the assembled components. Such individual installation of the various components is time consuming and costly, and thus undesirable from a manufacturing perspective.

Therefore, a primary objective of the present invention is the provision of an improved heavy duty vehicle door latch assembly.

Another objective of the present invention is the provision of a heavy duty door latch assembly which is preassembled as a singular modular unit for subsequent assembly on to the door of the vehicle.

Another objective of the present invention is the provision of a heavy duty door latch assembly having multiple modules interconnected to form a single, rigid unit which can be quickly and easily installed on a door of a heavy duty vehicle.

Still another objective of the present invention is the provision of a heavy duty door latch assembly which is mounted on the inside of a vehicle door using a total of only 4-6 fasteners.

Still another objective of the present invention is the provision of a heavy duty vehicle door latch assembly which prohibits accidental vehicle lockout.

Another objective of the present invention is the provision of a heavy duty vehicle door latch assembly which can be quickly opened from inside the vehicle with a single actuation step, whether the door is locked or unlocked.

A further objective of the present invention is the provision of a heavy duty vehicle door latch assembly having a release lever which overrides a lock lever from inside the vehicle.

Yet another objective of the present invention is the provision of a heavy duty vehicle door latch assembly having a bell crank module to allow opening of the vehicle door from outside the vehicle.

Still another objective of the present invention is the provision of a heavy duty vehicle door latch assembly having a latch module, a release module, and a bell crank module, all of which are assembled into an integral unit for installation on the vehicle door.

A further objective of the present invention is the provision of a heavy duty vehicle door latch assembly having a modular design to allow for application to multiple door layouts and arrangements.

Another objective of the present invention is the provision of a heavy duty vehicle door latch assembly which replaces conventional, complex latch-logic locking mechanisms with a simple locking rod mechanism to disallow movement of the latch rotor.

Still another objective of the present invention is the provision of a heavy duty vehicle door latch assembly having latch and release modules with interconnecting actuation rods extending through a tube which forms a door handle for a person inside the vehicle.

Another objective of the present invention is to provide a single latch and release unit which can be surface mounted on the inside of a flat door.

Yet another objective of the present invention is the provision of an improved heavy duty vehicle door latch assembly for use on armored military vehicles which is durable in use.

BRIEF SUMMARY OF THE INVENTION

A modular assembly is provided for latching, locking, and opening a vehicle door mounted in a door frame for movement between open and closed positions. The assembly includes a latch module, a release module, and a bell crank module, all of which are interconnected to form a single, pre-assembled unit for mounting to the door.

The latch module includes a rotor and a catch adapted to engage and disengage a striker bolt on the door frame. The release module includes a release lever and a lock lever. A release rod extends between the release lever and the latch module. A lock rod extends between the lock lever and the latch module. The bell crank module includes a bell crank lever and a bell crank rod extending between the bell crank lever and the latch module.

The lock lever is moveable between locked and unlocked positions. In the unlocked position, the rotor of the latch module is free to rotate between open and closed positions. The rotor is spring biased to the open position, and the catch holds the rotor in the closed position. When the lock lever is moved to the locked position, a locking pin engages the catch, and thereby prevents the rotor from moving from the open position to the closed position.

The release lever is moveable between a neutral position and an actuated position. When the release lever is in the neutral position, the door can be closed, latched, and locked. When the door is closed and the rotor is latched or locked, and the release lever is actuated, the release rod moves a first arm in the latch module to pivot the catch, and thereby open the rotor, so that the door is unlatched. Actuation of the release lever also automatically moves the lock lever to the unlocked position, such that the rotor is free to move to the open position, without a separate step of moving the lock lever to the unlocked position. Thus, the release lever allows the door to be opened by a person inside the vehicle in a single step, whether the latch module is locked or unlocked.

The bell crank lever moves between a neutral closed position and an actuated open position. Actuation of the bell crank lever is accomplished through the exterior push button door handle of the vehicle. When the door is closed and the lock lever is in the locked position such that the latch rotor is locked, the bell crank lever cannot be actuated from outside the vehicle. When the door is closed and the lock lever is in the unlocked position, the bell crank lever can be actuated by the outside handle of the vehicle to move the rotor from the closed position to the open position, thereby unlatching the latch module for opening the door from outside the vehicle.

The assembly has an anti-lockout feature. When the door is open and the rotor is in the open position, movement of the lock lever to the locked position precludes movement of the rotor to the closed position, such that the door cannot be accidentally locked.

DETAILED DESCRIPTION OF THE PREFERRED EMBODIMENT

Figure 2:
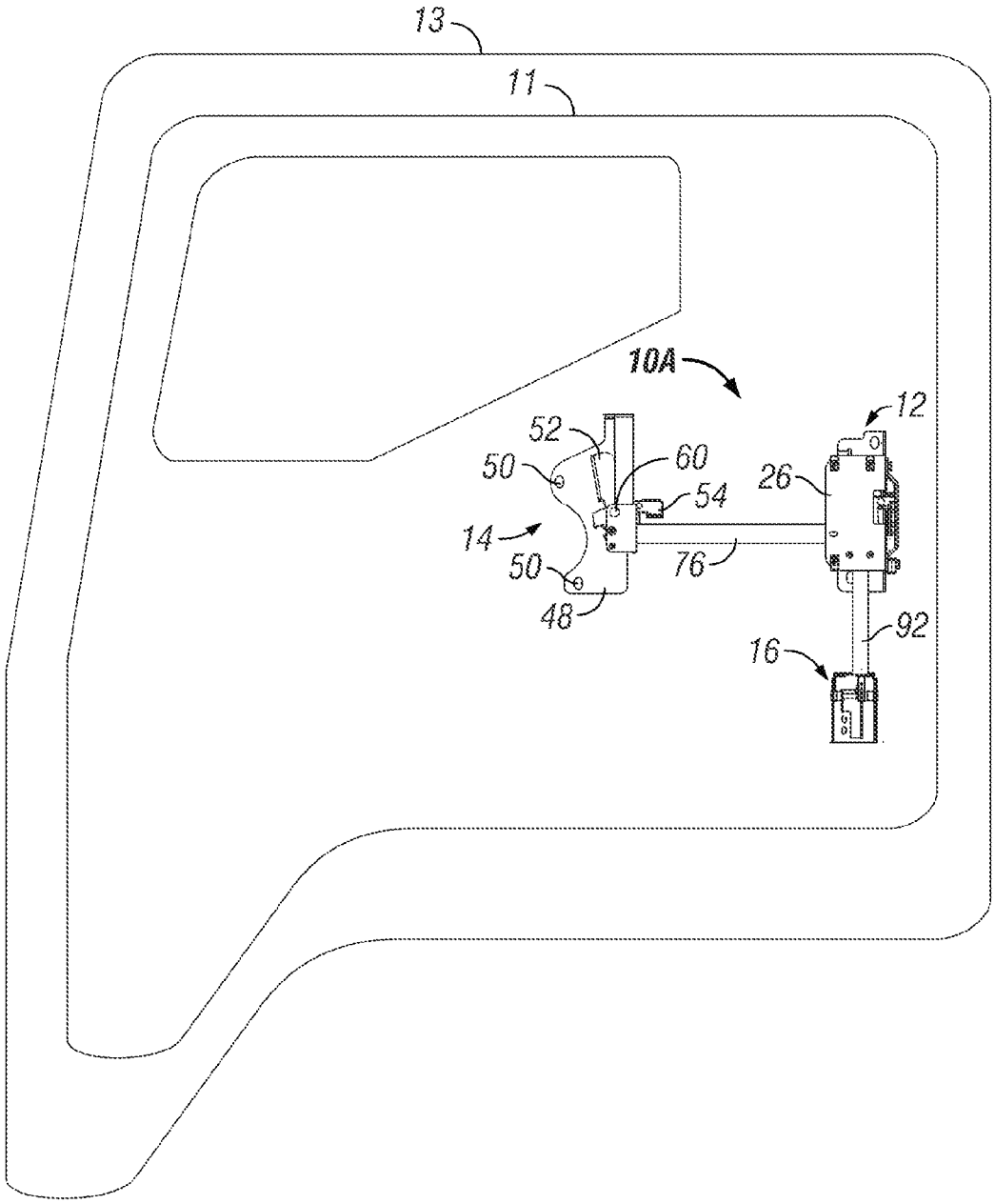
FIG. 2 is a front elevation view of the inside door assembly shown in FIG. 1.
Figure 3:
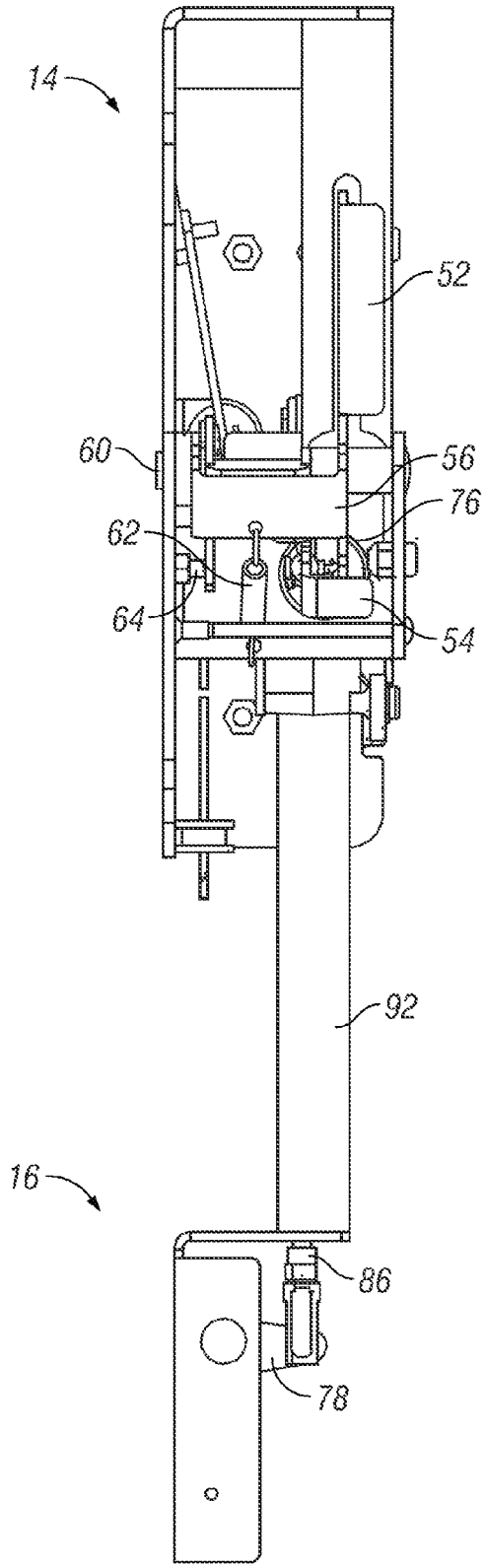
FIG. 3 is an end elevation view of the latch and release modules of the assembly shown in FIG. 1, with the cover removed for clarity.
Figure 4:
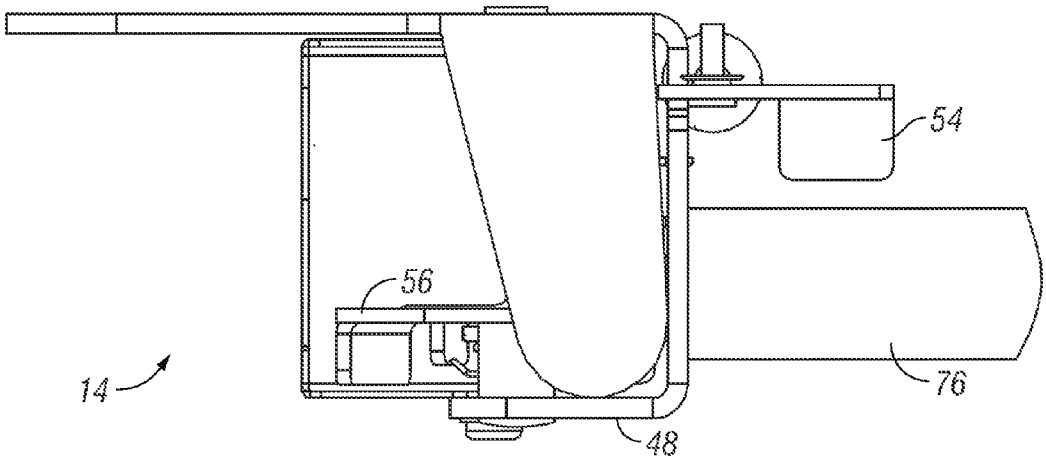
FIG. 4 is a bottom plan view of the release module of the assembly shown in FIG. 1.
Figure 5:
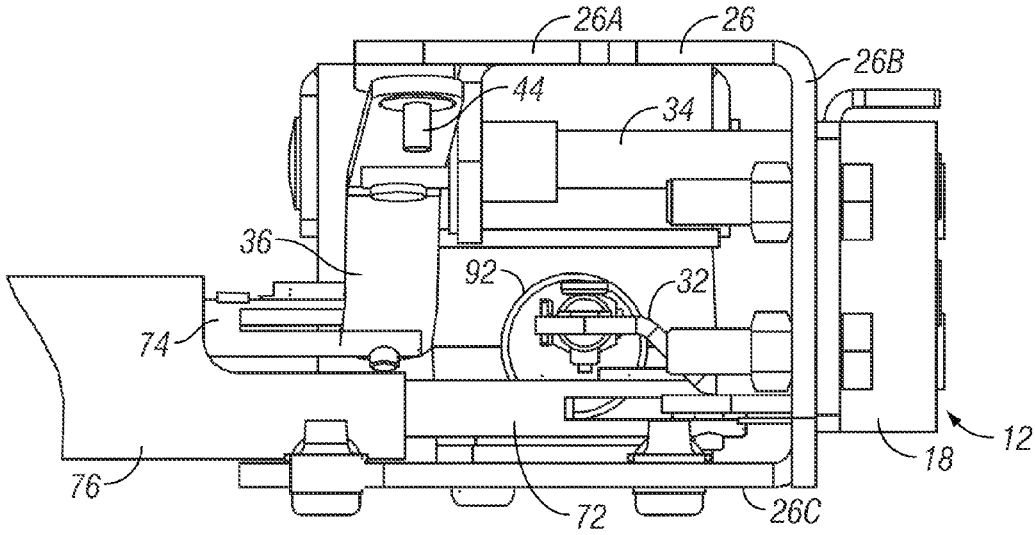
FIG. 5 is a top plan view of the latch module of the assembly shown in FIG. 1, with the cover removed for clarity.
Figure 9:
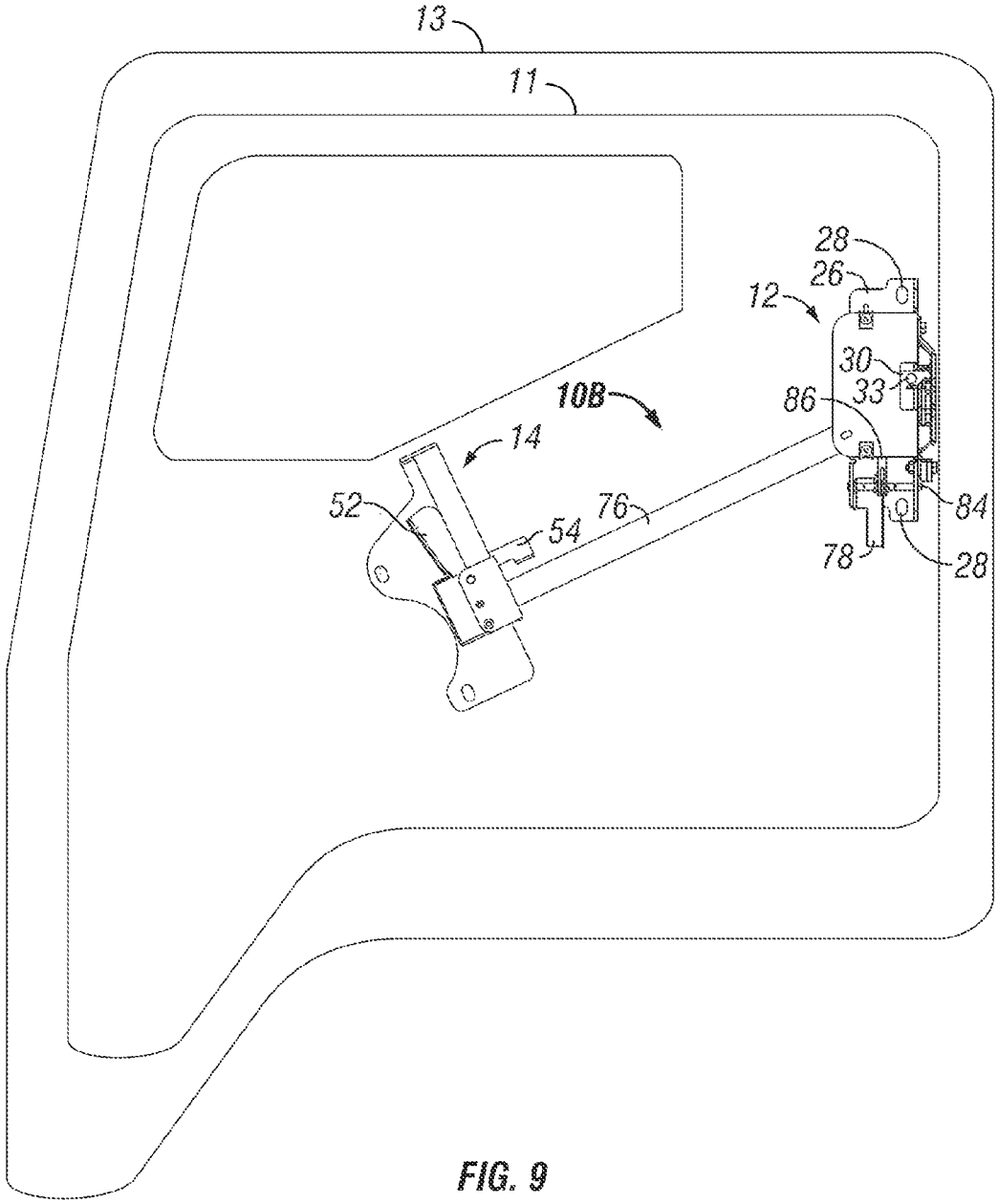
FIG. 9 is a front elevation view of the inside door assembly shown in FIG. 8.
Figure 10:
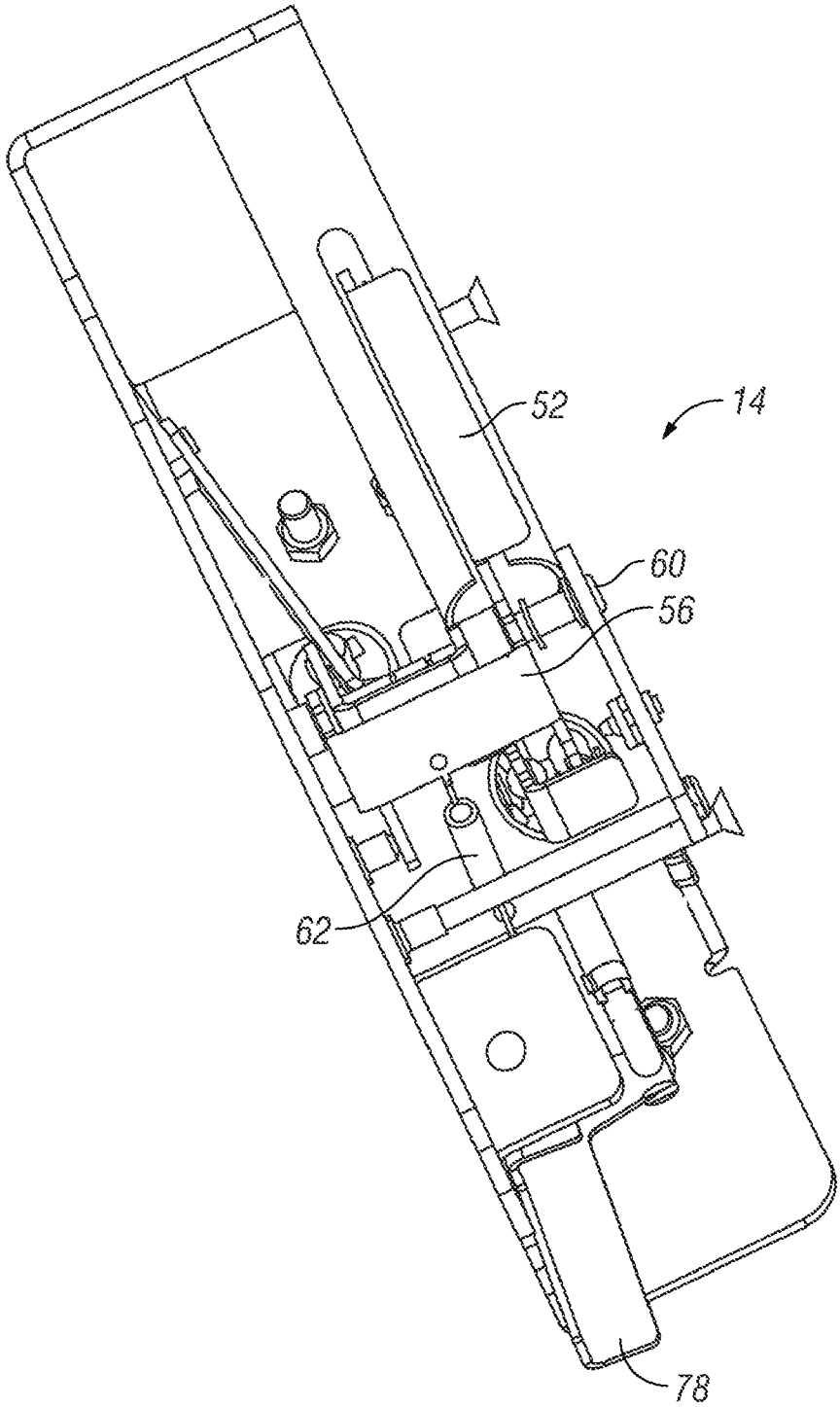
FIG. 10 is an end elevation view of the assembly of FIG. 8.
Figure 11:
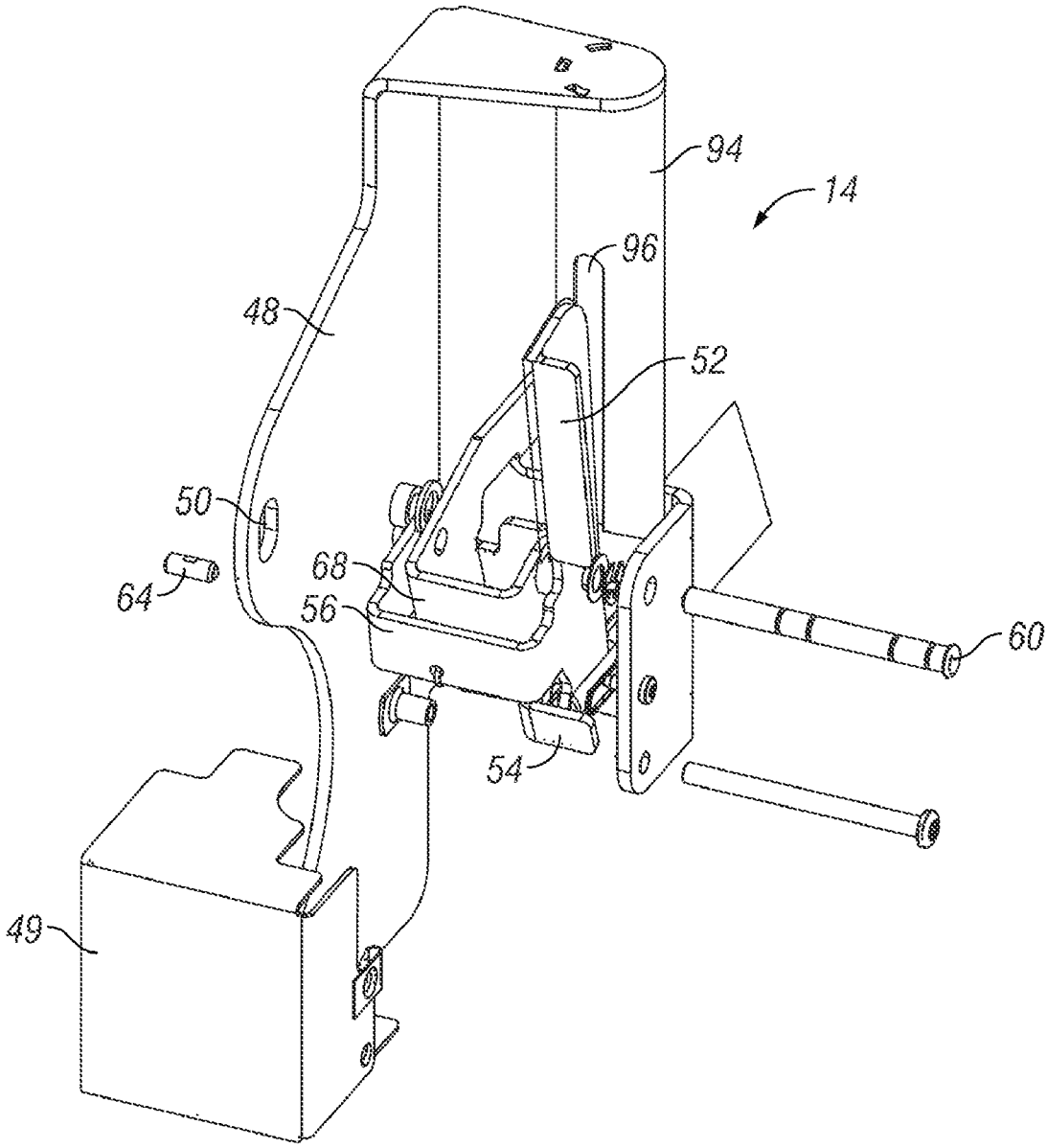
FIG. 11 is a perspective view of the latch module of the assembly shown in FIG. 8, with the cover exploded for clarity.
Figure 12:
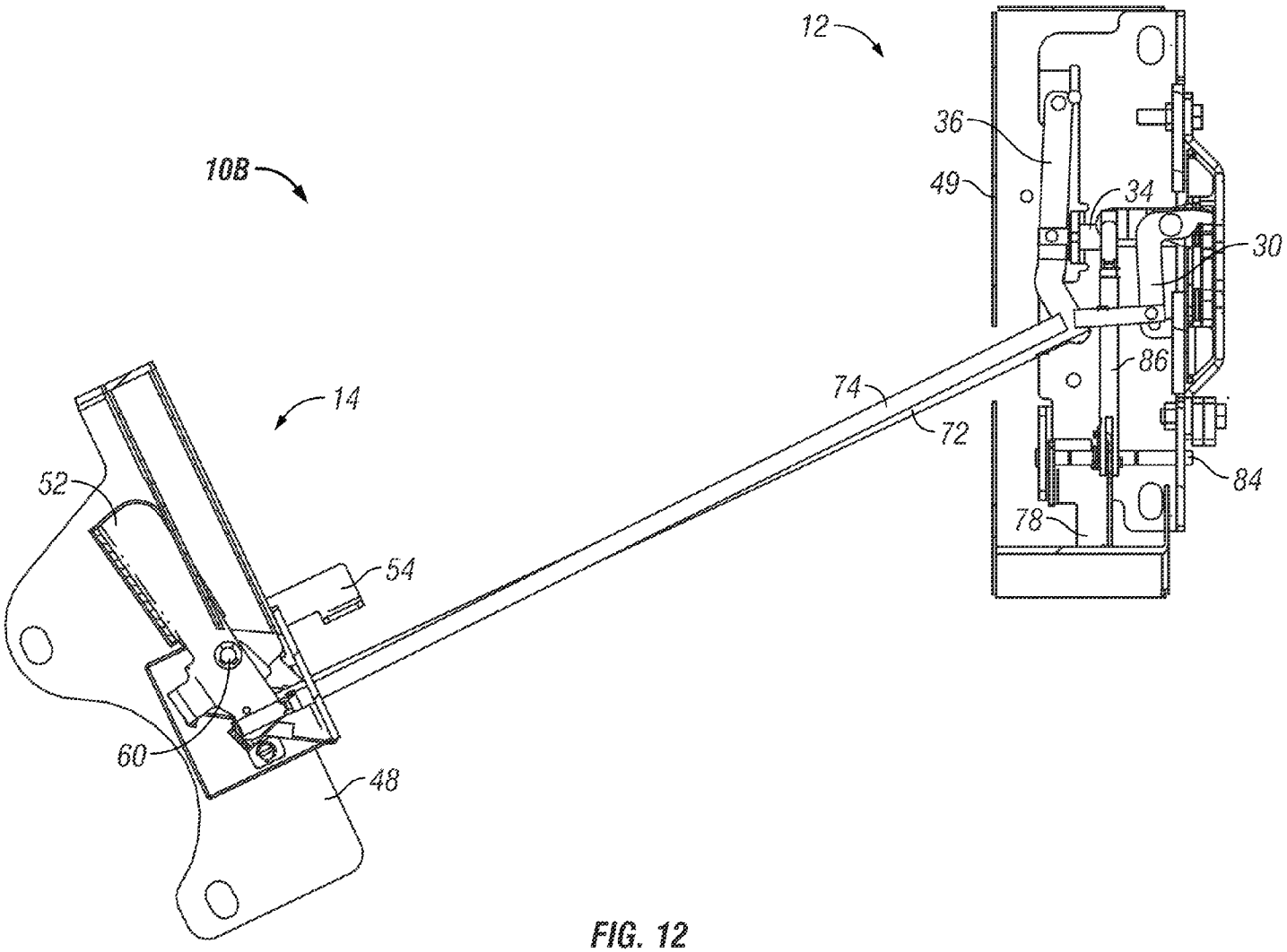
FIG. 12 is a view similar to FIG. 9, with cover portions and tube removed for clarity.
Figure 13:
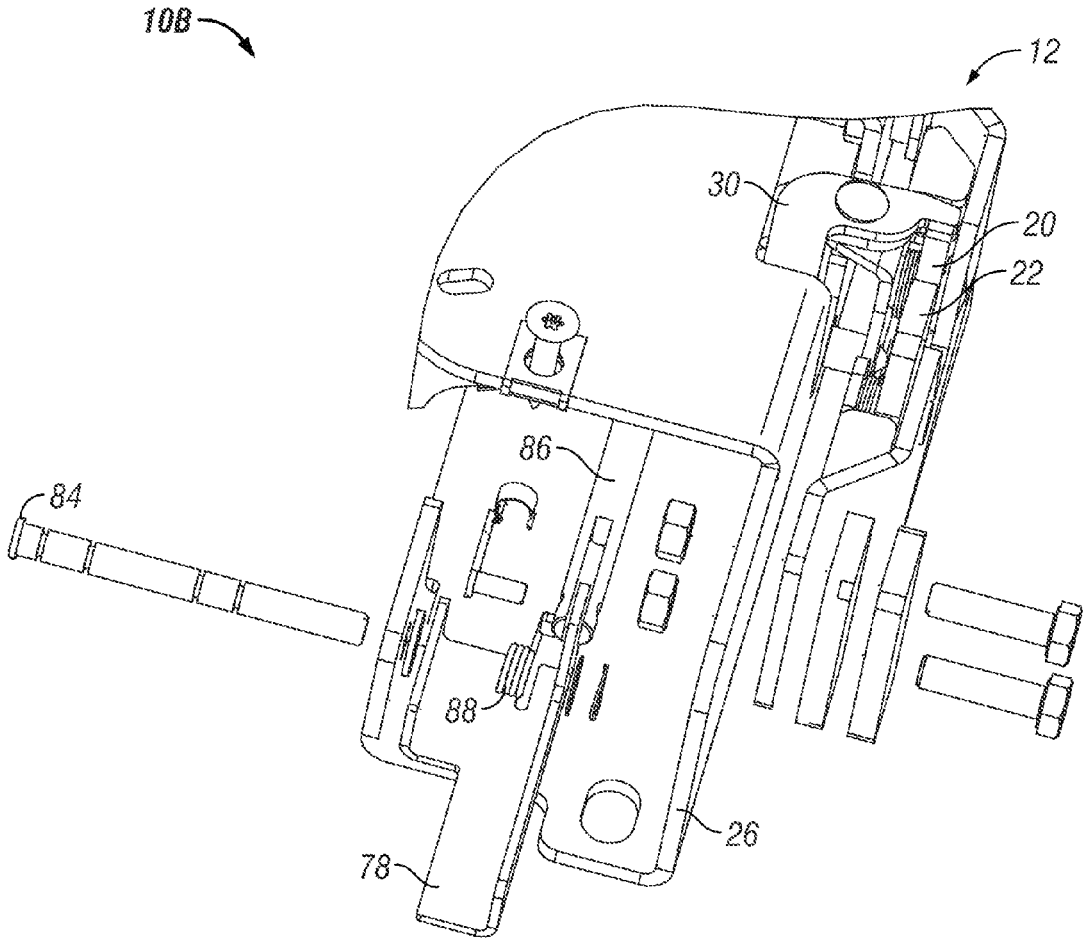
FIG. 13 is a partially exploded view of the latch module with the integrated bell crank module.
Figure 14:
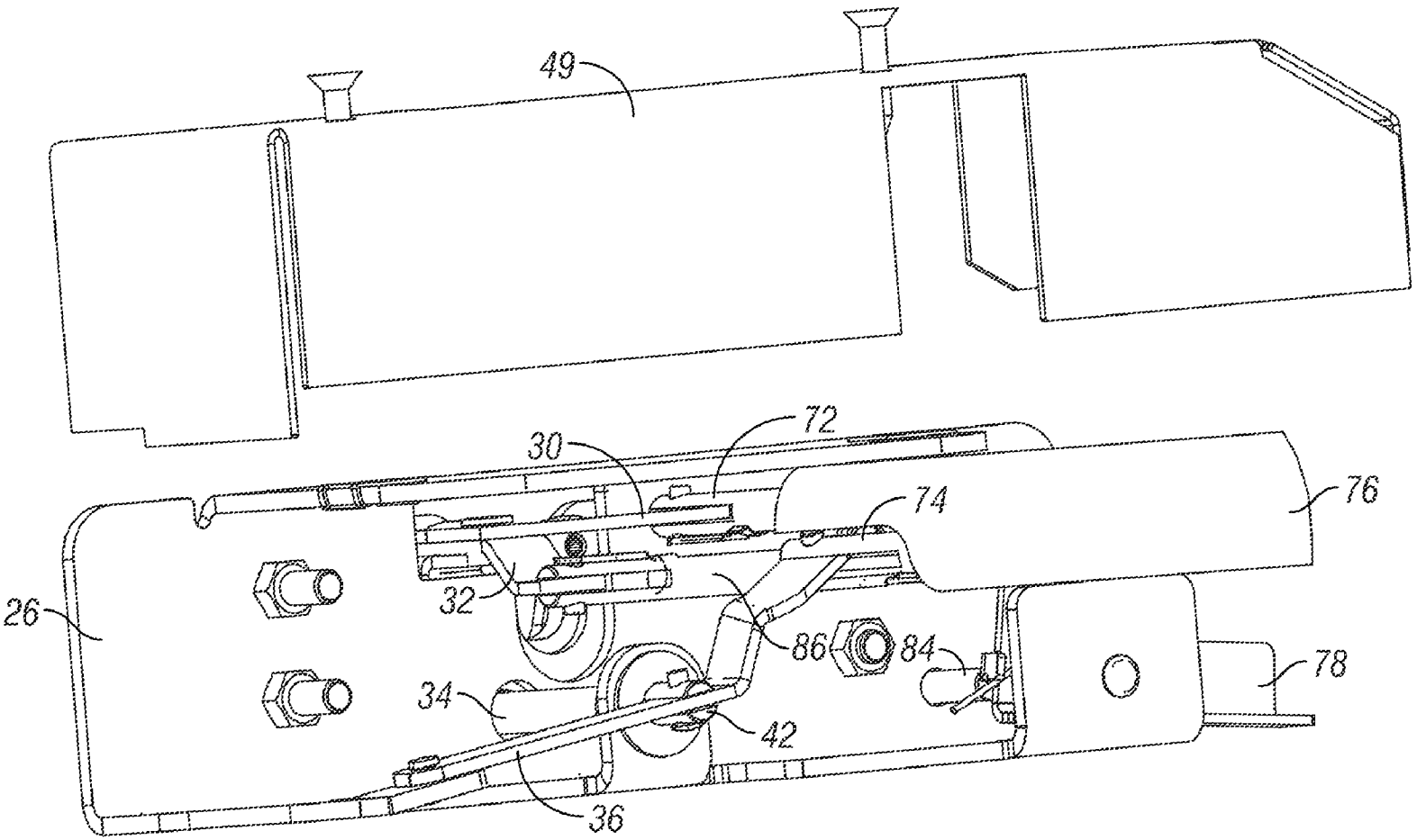
FIG. 14 is another view of the latch module of the assembly shown in FIG. 8, with the cover exploded.
Figure 15:
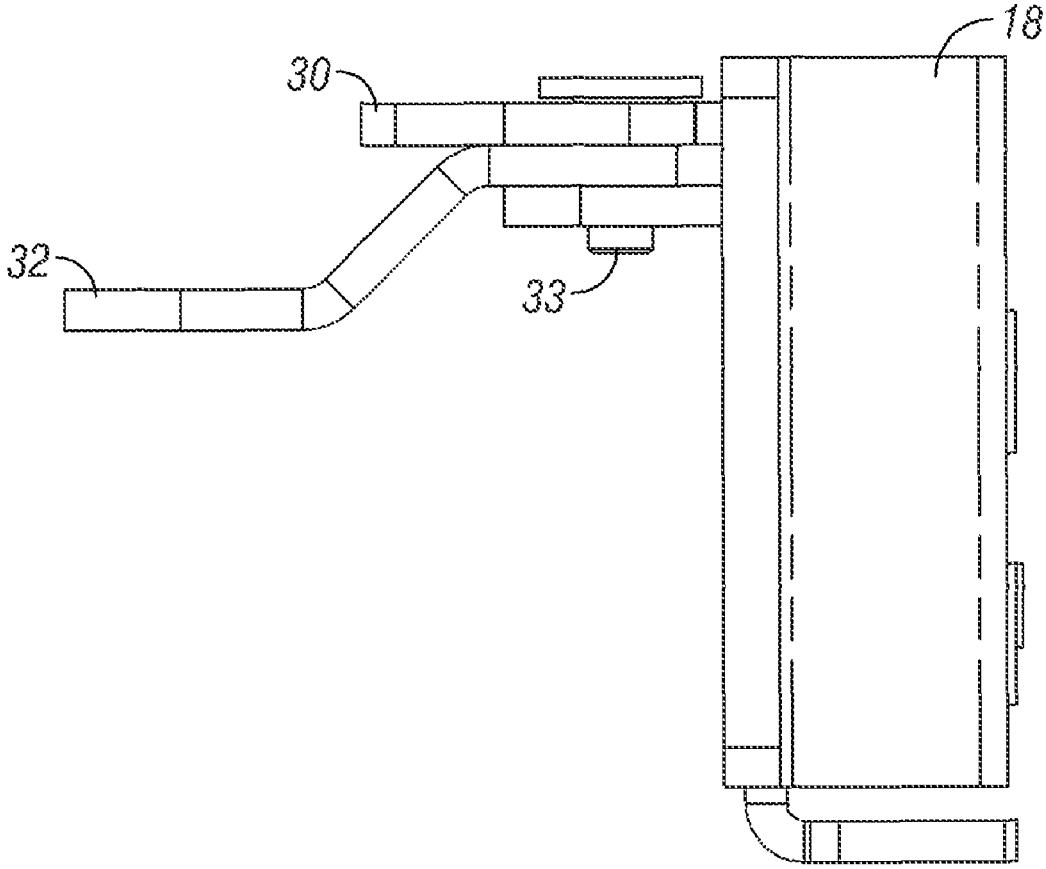
FIG. 15 is a side elevation view of the assembled latch mechanism and arms
Figure 16:
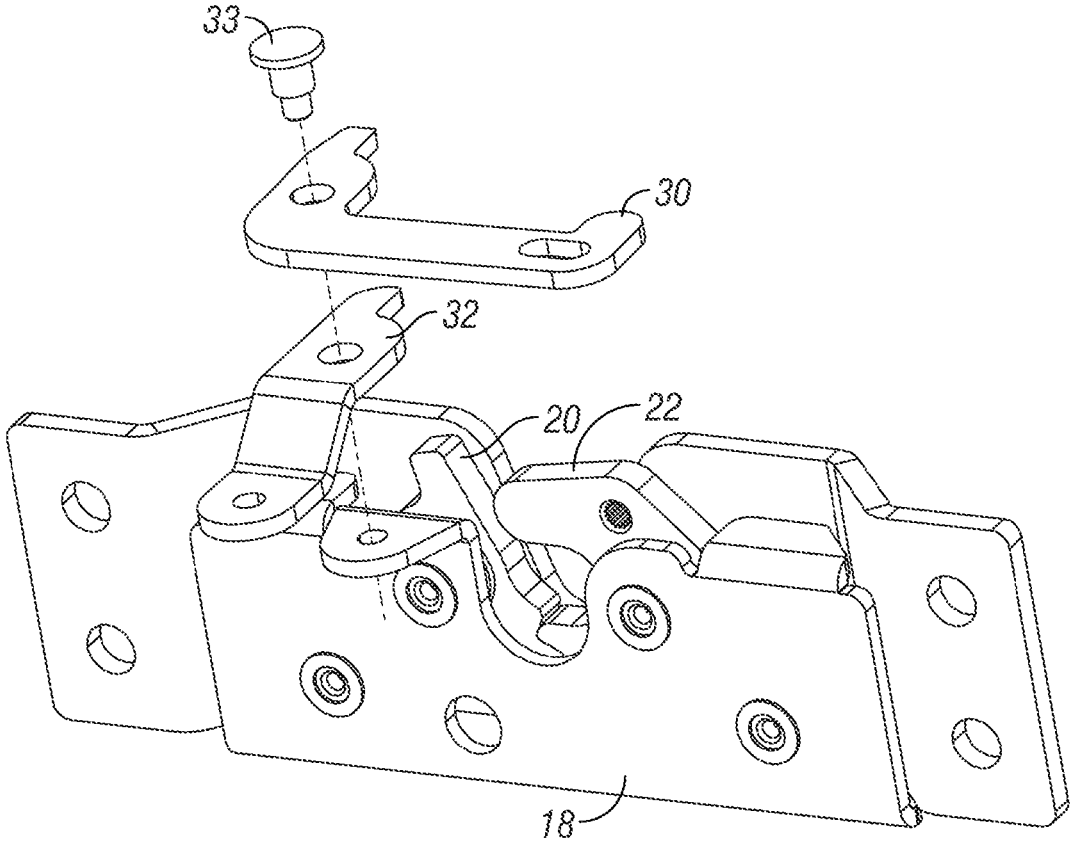
FIG. 16 is a partially exploded perspective view of the latch mechanism and arms of the latch module according to the present invention.
Figure 17:
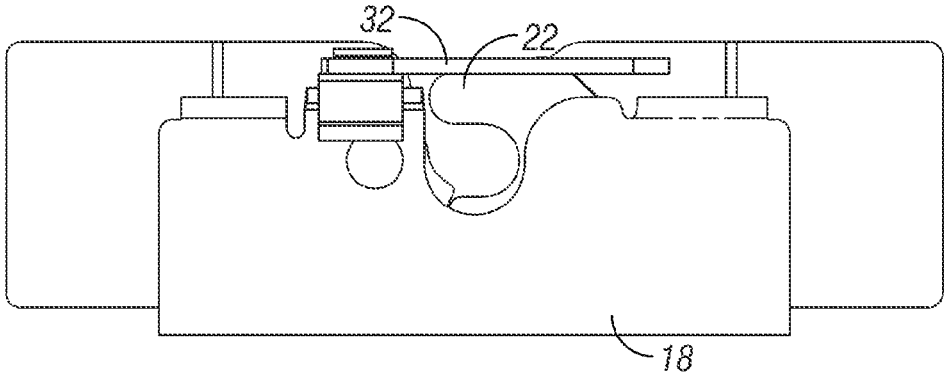
FIG. 17 is a plan view of the assembled latch mechanism and arms.
Figure 18:
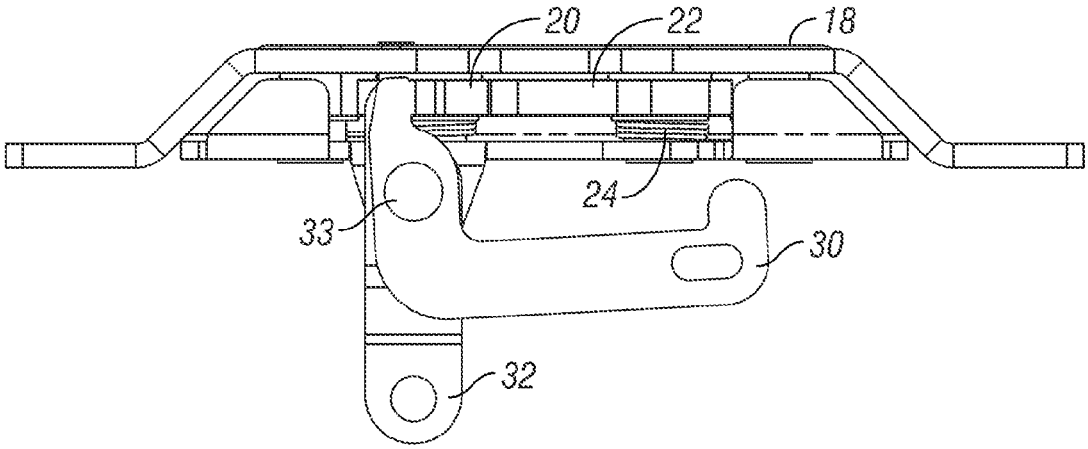
FIG. 18 is an end view of the assembled latch mechanism and arms.
Figure 19:
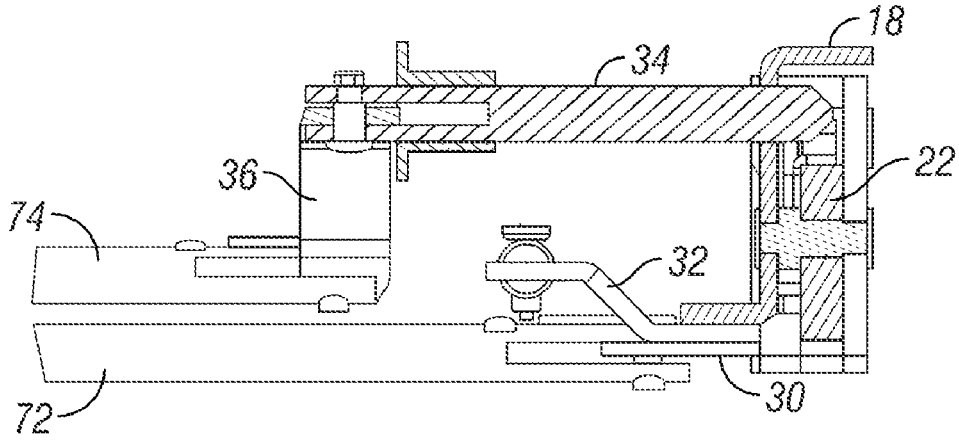
FIG. 19 is a partial sectional view showing the lock pin in a locked position.
Figure 20:
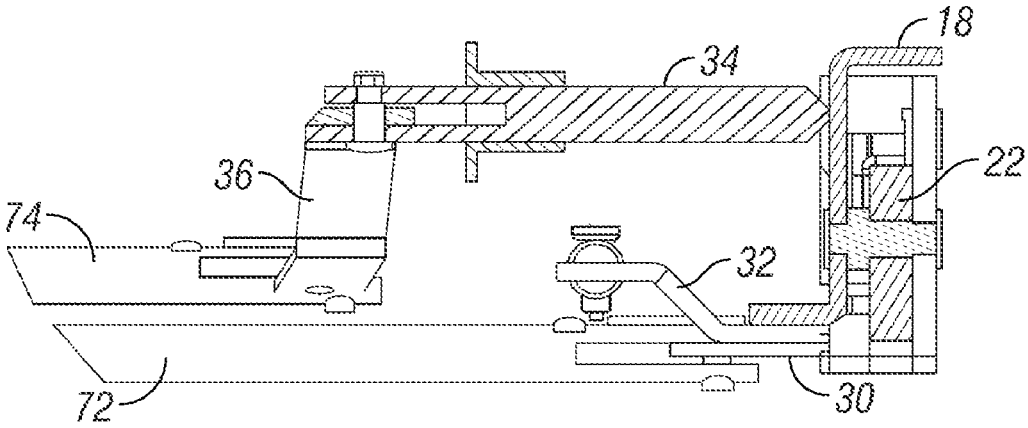
FIG. 20 is a partial sectional view showing the lock pin in an unlocked position.
Figure 21:
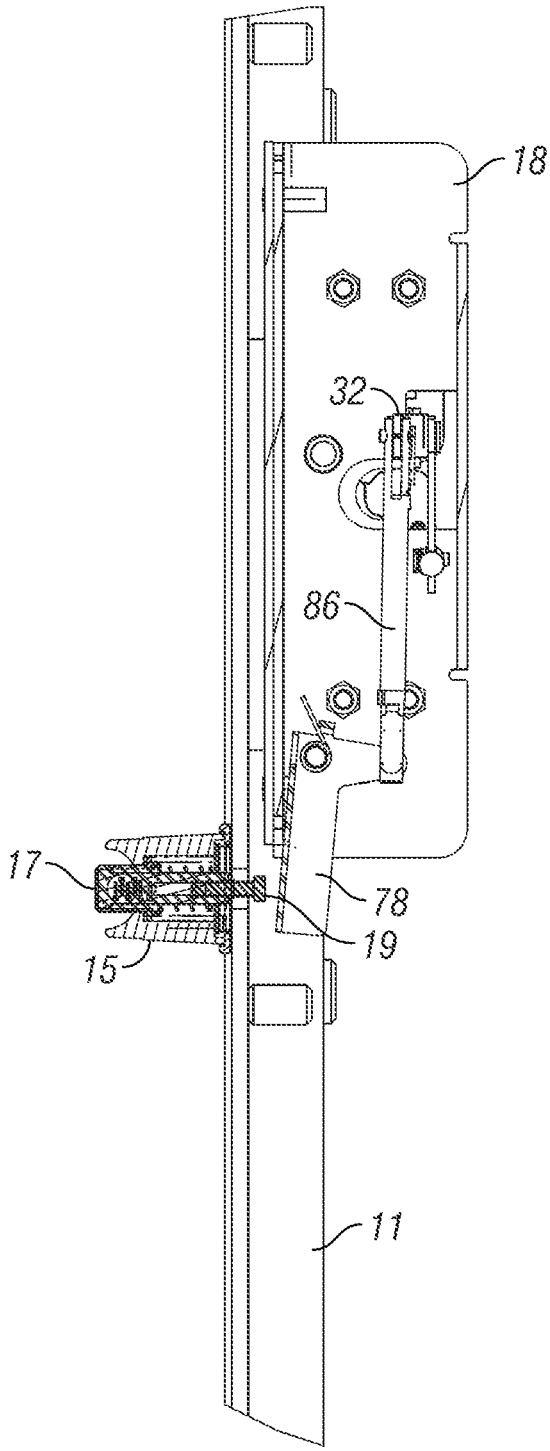
FIG. 21 is a sectional view of the integral bell crank module of the second embodiment and the exterior push button door handle in a deactivated state.
Figure 23:
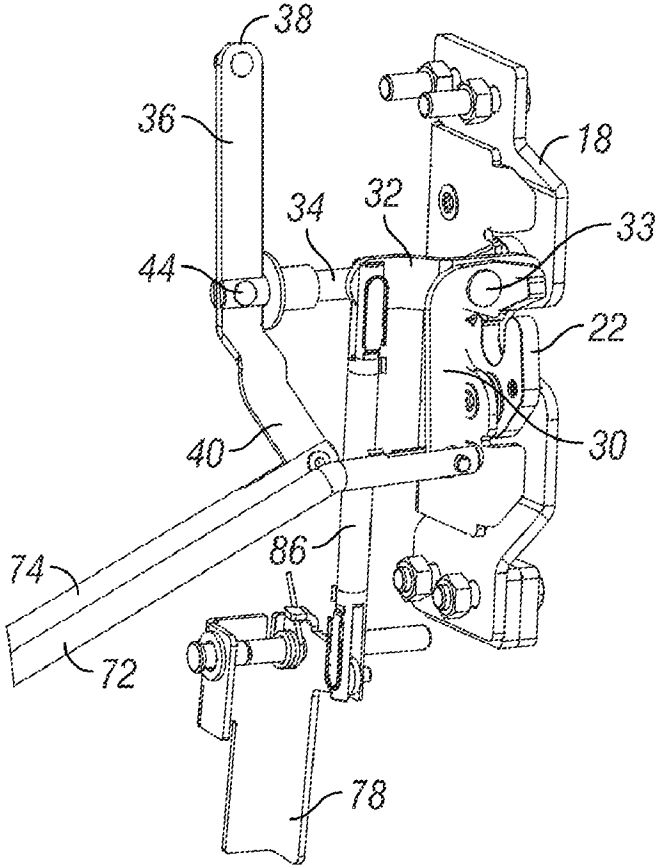
FIG. 23 is a skeletal view of the actuation rods and levers for the second embodiment.
Figure 22:
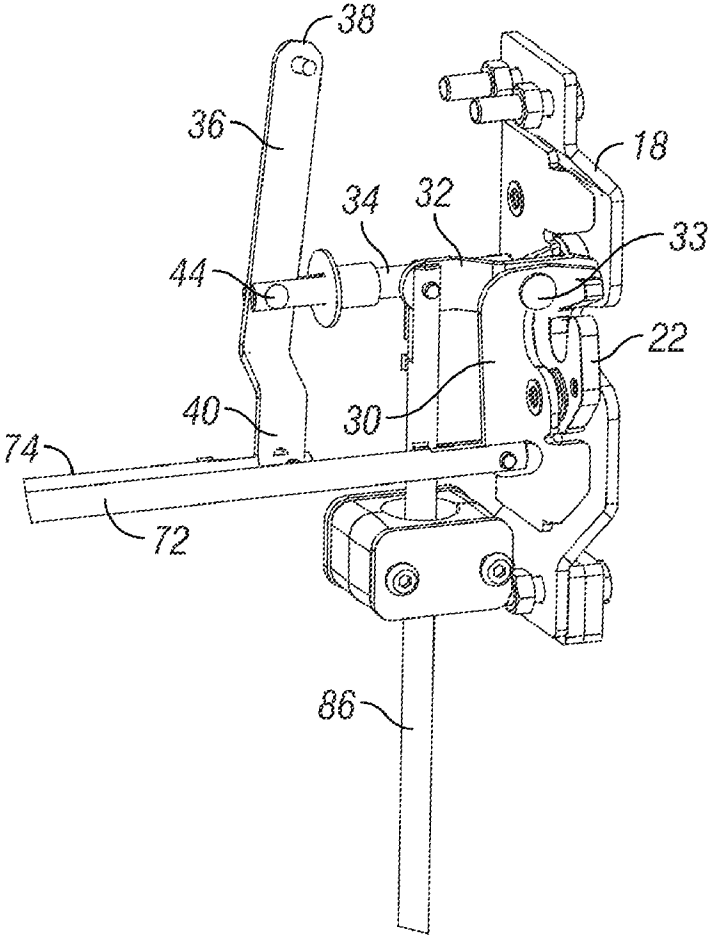
FIG. 22 is a skeletal view of the actuation rods and levers for the first embodiment.

In the drawings a heavy weight door, such as an armored door of a military vehicle is generally designated by the reference numeral 11. The door 11 is mounted to a door frame 13 by hinges for movement between open and closed positions. The door 11 and frame 13 are shown in FIGS. 2 and 9. The door includes a conventional exterior handle 15 with a push button 17 and a plunger 19, as seen in FIG. 21.

A first embodiment of the heavy duty vehicle door latch assembly of the present invention is generally shown in FIGS. 1-7 and designated by the reference numeral 10A. A second embodiment of the assembly is shown in FIGS. 8-14 and is designated by the reference numeral 10B. Both embodiments include a latch module 12, a release module 14, and a bell crank module 16. In the first embodiment of the assembly 10A, the bell crank module 16 is remote from the latch module 12. In the second embodiment of the assembly 10B, the bell crank module 16 is integral or incorporated with the latch module 12, rather than being remote therefrom. Otherwise, the latch and release modules 12, 14 are substantially identical in both assembly embodiments 10A and 10B.

The latch module 12, release module 14, and bell crank module 16 are interconnected so as to form a single, rigid, modular unit which is pre-assembled before mounting the unit to the inside of the door 11.

Figure 6:
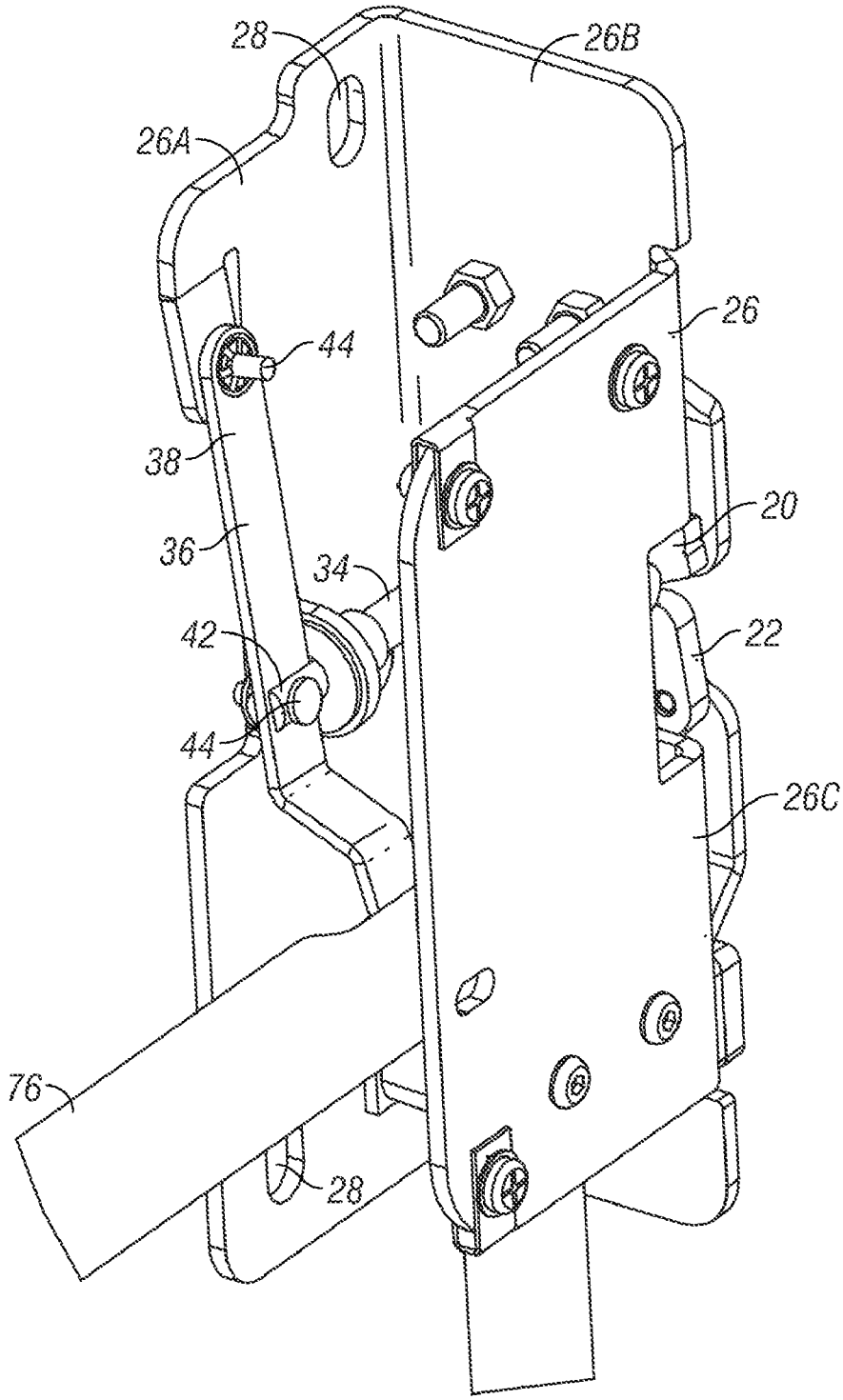
FIG. 6 is a perspective view of the latch module of the assembly shown in FIG. 1 with the cover removed for clarity.
Figure 7:
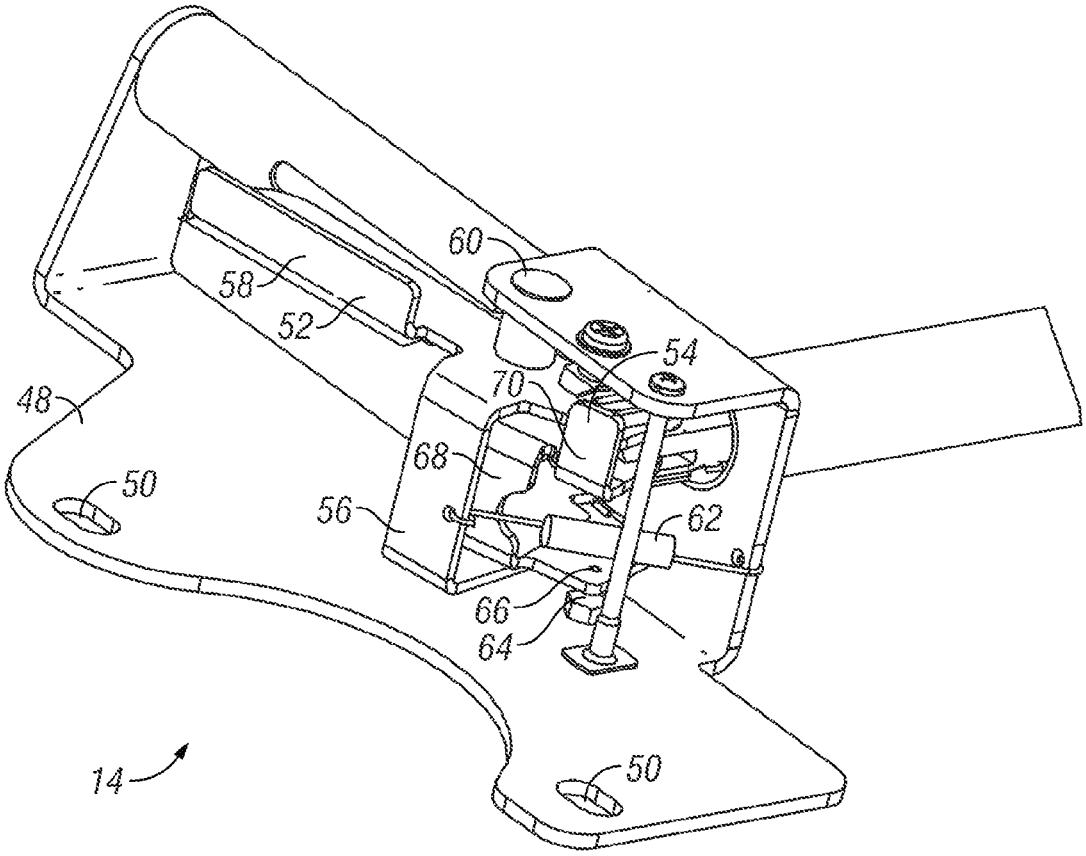
FIG. 7 is a perspective view of the release module of the assembly shown in FIG. 1, with the cover removed for clarity.
Figure 8:
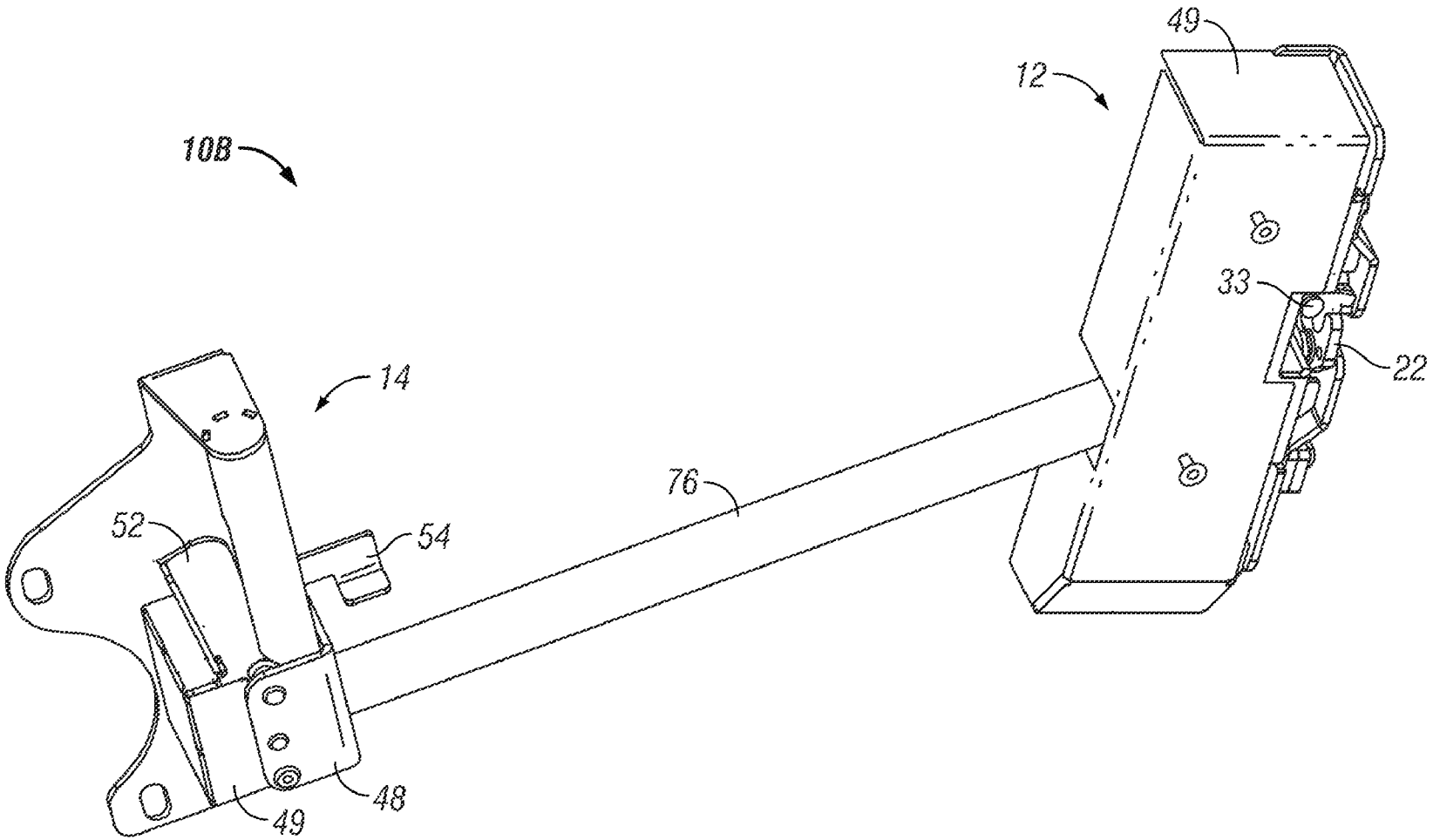
FIG. 8 is a perspective view of a second embodiment of the assembly of the present invention, including a latch module and a release module with an integrated bell crank module.

The latch module 12 includes a housing 18 which pivotally supports a catch 20 and a rotor 22. The rotor 22 is pivotal between open and closed positions, but is biased to the open position by a spring 24. The rotor 22 is adapted to engage and disengage a striker bolt (not shown) on the door frame 13, such that the door 11 is moveable between a latched close position and an unlatched open position. The latch module 12 also includes a mounting bracket 26 having two holes 28 for mounting the latch module 12 to the inside of the door 11 using a pair of bolts (not shown). The bracket 26 is U-shaped so as to define walls 26A, 26B and 26C, as seen in FIG. 6. The latch housing 18 is bolted or otherwise secured to the central wall 26B. The holes 28 are in the exterior wall 26A.

The latch module 12 also includes first and second arms 30, 32 which are pivotally mounted to the housing 18 by a pin 33. The latch arms 30, 32 are best seen in FIGS. 15-18. The arms 30, 32 function to trip the catch 20 so that the rotor 22 will pivot from the closed position to the open position under the bias of the spring 24, as described in further detail below.

The latch module 12 further includes a locking pin 34 moveable between extended and retracted positions. In the extended position, the locking pin 34 locks the catch 20 against movement, so that the rotor 22 cannot be released from the closed position, or move from the open position to the closed position. In the retracted position, the locking pin 34 is disengaged from the catch 20, which is therefore free to pivot to allow the rotor 22 to move between the closed position and the open position.

Movement of the locking pin 34 between the extended and retracted positions is controlled by an arm 36. The arm 36 has a first end 38 and a second end 40. The first end 38 of the arm 36 is pivotally connected to the exterior wall 26A of the bracket 26, with the second end 40 being free to move back and forth, as described below. The locking pin 34 is attached to the arm 36 between the first and second ends 38, 40 in any convenient manner. For example, as seen in FIG. 6, the inner end of the locking pin 34 includes a device 42 which mounts to the arm 36 via a bolt or pin 44. Thus, when the second end 40 of the arm 36 is pulled, the arm 36 pivots about the first end 38 so as to pull the locking pin 34 to a retracted position. When the second end 40 of the arm 36 is pushed, as described below, the arm 36 pivots about the first end 38 so as to push the locking pin 34 into the extended position engaging the catch 20 to prevent opening of the rotor 22.

Figure 1:
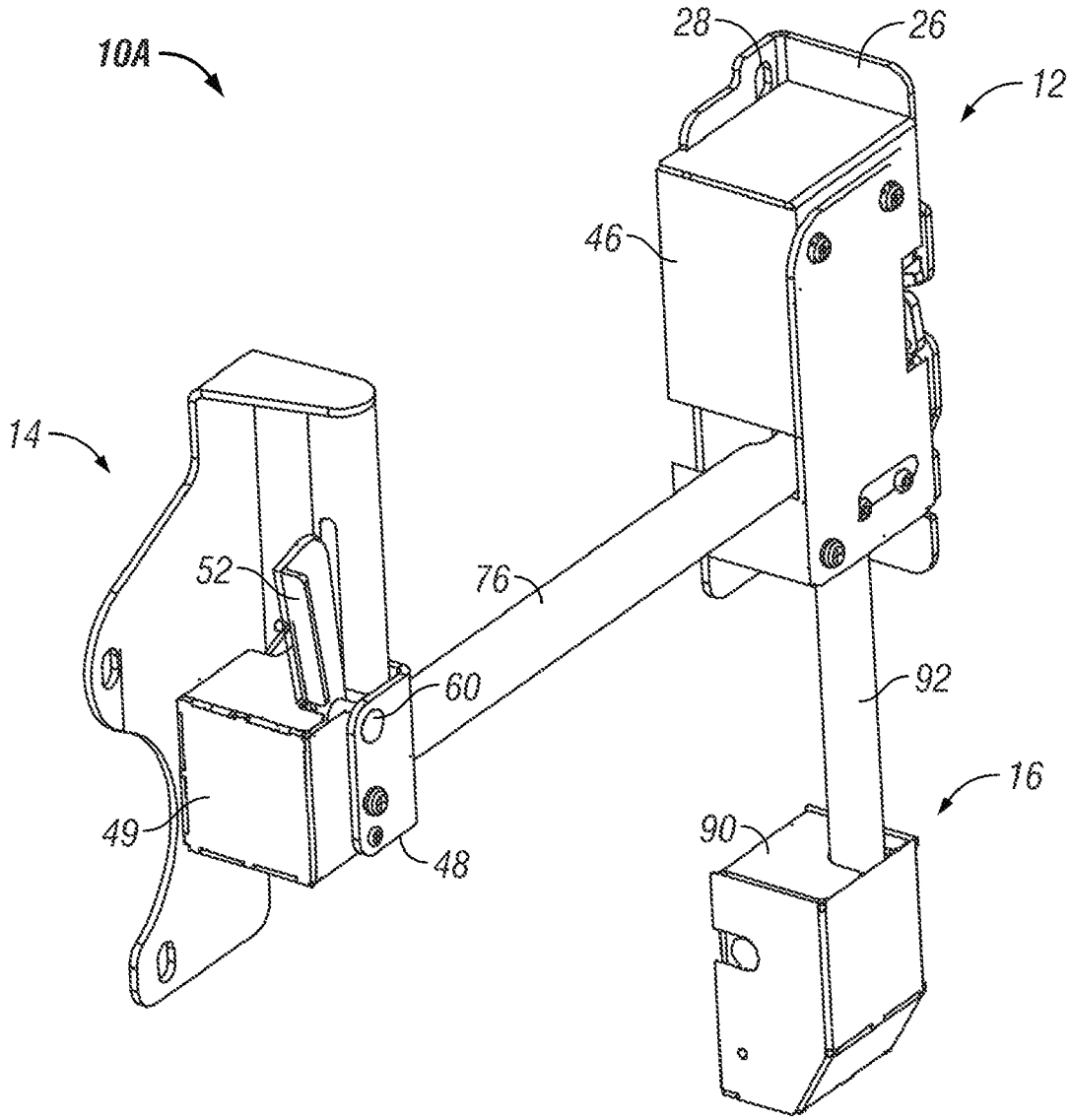
FIG. 1 is a perspective view of a first embodiment of the assembly of the present invention, including a latch module, a release module, and a remote bell crank module.

A cover plate 46 can be mounted to the bracket 26 of the latch module 12 so as to enclose the module, as best seen in FIG. 1.

The release module 14 includes a mounting bracket 48 with a pair of holes 50 for mounting the release module 14 to the interior of the door 11 using a pair of bolts. The latch 18 mounted to the bracket 48 with four bolts. A housing 49 is secured to the bracket 48 to enclose the release module 14. The release module 14 further includes a release lever 52 and a lock lever 54. The release lever 52 includes a U-shaped body 56 and a hand grip portion 58 extending from the body 56. The release lever 52 is pivotally mounted to the bracket 48 by an elongated pin 60 so that the release lever 52 is moveable between a normal or neutral position and an actuated position. The release lever 52 is biased to the neutral position by a spring 62, best shown in FIG. 7.

The lock lever 54 is pivotally mounted to the bracket 48 by the pin 60 so as to be moveable between locked and unlocked positions. A detent 64 engages spaced apart depressions 66 in the lock lever 54 so as to retain the lock lever in the selected locked or unlocked position. The lock lever 54 has a U-shaped body 68 with a finger tab portion 70 extending from the body 68. If the lock lever 54 is in the locked position, when the release lever 52 moves from the neutral position to the actuated position, a portion of the release lever body 56 engages a portion of the lock lever body 68 to automatically move the lock lever 54 from the locked position to the unlocked position. The release lever 52 and the lock lever 54 are both mounted on a pin 60, which defines the pivot axis for both levers 52, 54.

A release rod 72 extends between the release lever 52 and one end of the first latch arm 30. A lock rod 74 extends between the lock lever 54 and an end of the latch arm 32. The ends of the rods 72, 74 are secured to the connecting structures by pins, rivets, bolts, or other convenient fasteners. The rods 72, 74 extend through a tube 76 having opposite ends welded or otherwise attached to the latch bracket 26 and the release bracket 48. The tube 76 protects the rods 72, 74 from being bent, and also provides a hand grip for a passenger in the vehicle to open and close the door 11.

It is understood that the length of the rods 72, 74 and 86 and the tube 76 can be varied so as to accommodate different vehicle doors. Also, the relative position of the latch module 12 relative to the release module 14 can be varied to accommodate different vehicle doors. For example, in FIG. 2, the latch module 12 and release module 14 are oriented substantially on the same horizontal plane, whereas in FIG. 9, the latch module 12 is positioned above the release module 14.

An upwardly extending hand grip 94 is welded to the bracket 48, and includes a slot 96 for receiving a portion of the release lever 52 when the lever 52 is actuated. The grip 94 facilitates squeezing actuation of the release lever 52 by a person in the vehicle.

The bell crank module 16 includes a bell crank lever 78. In the first embodiment 10A of FIGS. 1-7, the bell crank lever 78 is pivotally mounted in a U-shaped bracket 80 having a pair of holes 82 for mounting the bell crank module 16 to the inside of the door 11. A bolt or pin 84 defines the pivot axis for the bell crank lever 78. In the second embodiment 10B shown in FIGS. 8-14, the bell crank lever 78 is mounted in the latch bracket 26 by the bolt or pin 84 so as to be integral with the latch module 12.

The bell crank module 16 also includes a connecting rod 86 having one end connected to the bell crank lever 78 and the opposite end connected to one end of the second latch arm 32. The length of the rod 86 is longer for the remote bell crank module of the first embodiment 10A, and shorter for the bell crank module of the second embodiment 10B. The rod 56 extends through a tube 92.

The bell crank module 16 is aligned with the outer door handle 15 of the door 11, such that actuation of the outside handle push button 17 or operating paddle pushes the plunger 19 into engagement with the bell crank lever 78 so as to pivot the bell crank lever 78 from a first neutral position to a second operative position. See FIG. 21. A hole is provided in the bell crank bracket 80 or in the latch bracket wall 26A to allow a reciprocating arm on the outer door handle to move the bell crank lever 78. The bell crank lever 78 is normally biased to the first position by a spring 88 on the pin 84. A housing 90 is secured to the bracket 80 so as to enclose the bell crank lever 78 and connecting rod 86.

In operation, the latch assemblies 10A, 10B function to latch, lock, unlock, unlatch, and open the door 11. When the door 11 is open, the rotor 22 is in an open position, and when the door is closed, the rotor 22 is normally in a closed position. If the lock lever 54 is in the unlocked position, the door 11 can be closed, wherein the rotor 22 will engage the striker bolt (not shown) on the door frame 13 and pivot to the closed or latched position and be retained by the catch 20 against the normal bias of a spring (not shown) which urges the rotor 22 to the open position. If the lock lever 54 is moved to the locked position while the door 11 is open, the lock rod 74 pushes the locking pin 34 to the extended position, which locks the catch 20 against rotation, which precludes rotation of the rotor 22 to the locked position. Accordingly, this safety feature prevents a person from being accidentally locked out of the vehicle by actuating the lock lever 54 while the door 11 is open. The lock lever 54 can be moved to the locked position to lock the rotor 22 only after the door 11 has been closed.

With the door 11 closed and latched, and with the lock lever 54 in the unlocked position, the door 11 can be opened from the inside by the release lever 52 or from the outside by actuation of the outside door handle. From the inside, actuation of the release handle or lever 52 pulls the release rod 72, which in turn pivots the first latch arm 30 about the pivot axis 33, thereby rotating the catch 20 out of engagement with the rotor 22, such that the rotor 22 is released for rotation by the biasing spring to the open position and disengagement from the striker bolt, so that the door 11 can be opened. A person can also open the door 11 from the outside when the rotor 22 is latched but not locked, by actuating the outside door handle which pivots the bell crank lever 78 about the axis 84 which pushes the connecting rod 86 so as to rotate the second latch arm 32 about the pivot axis 33, thereby rotating the catch 20 out of engagement with the rotor 22, such that the rotor 22 is released and pivots to the open position for disengagement from the striker bolt.

When the door 11 is closed, the rotor 22 is in the closed position. Movement of the lock lever 54 to the locked position pushes the lock rod 74 so as to extend the lock pin 34, which precludes rotation of the catch 20, such that the rotor 22 is locked against rotation from the closed position to the open position. When the rotor 22 is locked, the bell crank lever 78 is inoperative because arm 32 and the catch 20 cannot pivot. Thus, in the locked condition, a person cannot open the door from the outside using the outside door handle.

When the door 11 is locked, a person on the inside of the vehicle can open the door simply by actuating the release lever 52, and without the need to separately move the lock lever 54 from the locked position to the unlocked position. More particularly, with the door 11 locked, the release lever 52 can be squeezed or depressed so as to move from its normal or neutral position to its actuated position. Such movement rotates the U-shaped body 56 about the axis 60 so as to engage the body 68 of the lock lever 54, and thereby automatically pivot the lock lever 54 about axis 60 from the locked position to an unlocked position. Simultaneously, rotation of the release body 56 pulls the release rod 72 so as to pivot the first latch arm 30, which in turn pivots the catch 20 out of engagement with the rotor 22, such that the rotor 22 is biased to the open position to disengage the striker bolt, and thereby allow the door 11 to open.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. An assembly for actuating a vehicle door mounted in a door frame for movement between open and closed positions, the frame including a striker to retain the door in the closed position, the assembly comprising:

a latch module including a catch and rotor adapted to engage and disengage the striker;

a lock lever movable between locked and unlocked positions;

a release module including a release lever linked to the lock lever for actuation by a person inside the vehicle;

the release lever being movable between neutral and actuated positions, and when the lock lever is in the locked position, movement of the release lever from the neutral position to the actuated position automatically moves the lock lever to the unlocked position;

a release rod extending between release lever and the latch module whereby actuation of the release lever allows the rotor to move from a closed position to an open position;

a lock rod extending between the lock lever and the latch module whereby actuation of the lock lever precludes movement of the rotor from the closed position to the open position from outside the vehicle;

a bell crank module including a bell crank lever actuable by an outside door release on the exterior of the door, and a bell crank rod extending between the bell crank lever and the latch module; and the latch, release, and bell crank modules being pre-assembled to form a single rigid unit for surface mounting to an interior surface of the door.

2. The assembly of claim 1 further comprising a tube rigidly secured to and extending between the latch and release modules, and through which the release and lock rods extend for protection of the rods.

3. The assembly of claim 2 wherein the tube forms a hand grip for a person in the vehicle.

4. The assembly of claim 1 wherein the release lever is biased to the neutral position.

5. The assembly of claim 1 wherein the latch module includes a first pivotal arm extending between the release rod and the catch to pivot the catch in response to actuation of the release lever.

6. The assembly of claim 1 wherein the latch assembly includes a second pivotal arm extending between the bell crank rod and the catch to pivot the catch in response to actuation of the bell crank lever.

7. The assembly of claim 1 wherein the bell crank module is integral with the latch module.

8. The assembly of claim 1 wherein the bell crank module is remote from the latch module, and the assembly further comprising a tube extending between the bell crank and latch modules through which the bell crank rod extends.

9. The assembly of claim 1 wherein the bell crank lever cannot be actuated when the lock lever is in a locked position.

10. The assembly of claim 1 whereby when the rotor is in the open position, actuation of the lock lever precludes movement of the rotor to the closed position.

11. The assembly of claim 1 wherein the latch assembly includes a lock pin operatively connected to the lock rod for movement between a locked position which precludes operation of an exterior push button handle and associated opening of the rotor from outside the door and an unlocked position allowing opening of the rotor from outside the door.

12. The assembly of claim 11 wherein the locked position of the lock pin precludes closing of the rotor.

13. An assembly to control opening of a vehicle door, comprising:

a latch module on the door and including a rotor movable between open and closed positions;

a lock lever movable between a locked position precluding the rotor from moving between positions from outside the vehicle and an unlocked position allowing the rotor to move between positions;

a release module mounted on the door and having a release lever operatively connected to the lock lever;

a bell crank module including a bell crank lever actuable by an outside door handle on the exterior of the door, and a bell crank rod extending between the bell crank lever and the latch module;

whereby, when the lock lever is in the locked position, actuation of the release lever automatically moves the lock lever to the unlocked position and automatically moves the rotor to the open position to allow the door to open.

14. The assembly of claim 13 wherein the latch, release and bell crank modules form a single, pre-assembled unit for mounting to the door.

15. The assembly of claim 13 wherein the latch and release modules form a single, pre-assembled unit for mounting to the door.

16. The assembly of claim 13 further comprising a release rod extending between the release lever and the latch module, and a lock rod extending between the lock lever and the latch module.

17. The assembly of claim 16 further comprising a tube rigidly secured to and extending between the latch and release modules, and through which the release and lock rods extend for protection of the rods.

18. The assembly of claim 17 wherein the tube forms a hand grip for a person in the vehicle.

19. The assembly of claim 16 wherein the latch module includes a latch, and a first pivotal arm extending between the release rod and the catch to pivot the catch in response to actuation of the release lever.

20. The assembly of claim 19 wherein the latch assembly includes a second pivotal arm extending between the bell crank rod and the catch to pivot the catch in response to actuation of the bell crank lever.

21. The assembly of claim 16 wherein the latch assembly includes a lock pin operatively connected to the lock rod for movement between a locked position which precludes operation of an exterior push button handle and associated opening of the rotor from outside the door and an unlocked position allowing opening of the rotor from outside the door.

22. The assembly of claim 21 wherein the locked position of the lock pin precludes closing of the rotor.

23. The assembly of claim 13, whereby when the rotor is in the open position, movement of the lock lever to the locked position precludes movement of the rotor to the closed position.

24. The assembly of claim 13 wherein the release lever is movable between neutral and actuated positions, and when the lock lever is in the locked position, movement of the release lever from the neutral position to the actuated position automatically moves the lock lever to the unlocked position.

25. The assembly of claim 24 wherein the release lever is biased to the neutral position.

26. The assembly of claim 13 wherein the bell crank module is integral with the latch module.

27. The assembly of claim 13 wherein the bell crank module is remote from the latch module, and the assembly further comprising a tube extending between the bell crank and latch modules through which the bell crank rod extends.

28. The assembly of claim 13 wherein the bell crank lever cannot be actuated when the lock lever is in a locked position.

29. The assembly of claim 13 whereby when the rotor is in the open position, actuation of the lock lever precludes movement of the rotor to the closed position.

* * * * *